United States Patent [19]

Starr

[11] 4,158,423

[45] Jun. 19, 1979

[54] SEALABLE CLOSURE FASTENER

[75] Inventor: Anthony J. Starr, Wilmington, Del.

[73] Assignee: Container Corporation of America, Chicago, Ill.

[21] Appl. No.: 959,468

[22] Filed: Nov. 13, 1978

[51] Int. Cl.[2] ..... B65D 45/32

[52] U.S. Cl. ..... 220/320

[58] Field of Search ..... 220/319, 320, 321; 292/256.63, 256.65, 256.69, 256.67

[56] References Cited

U.S. PATENT DOCUMENTS 3,028,993 4/1962 Muhlhoff ..... 220/321

3,642,166 2/1972 Starr ..... 220/320

*Primary Examiner*—George T. Hall

*Attorney, Agent, or Firm*—Carpenter & Ostis

[57] ABSTRACT

A sealable closure arrangement for a container body and cover is disclosed. It includes a clamping structure for maintaining the body and cover in sealing engagement, the clamping structure including upper and lower extremities, the former engaging the cover and the latter the container body, there being a strand guided in the clamping structure and adapted to be tensioned to force the body and the cover in sealing engagement.

5 Claims, 7 Drawing Figures

SEALABLE CLOSURE FASTENER

FIELD OF THE INVENTION

This invention relates to improvements in containers formed from resilient and plastic material and having removable covers required to have a sealable connection with the container body.

SUMMARY OF THE INVENTION

The invention structure comprehends a container body and cover therefor, the two being maintained in sealed condition by a clamping band engaging a stiffener rib for the container body and the periphery of the container, the clamping band being constructed so as to deform by a tensional strand guided within the clamping band.

THE DRAWINGS

SPECIFICATION

Figure 3:
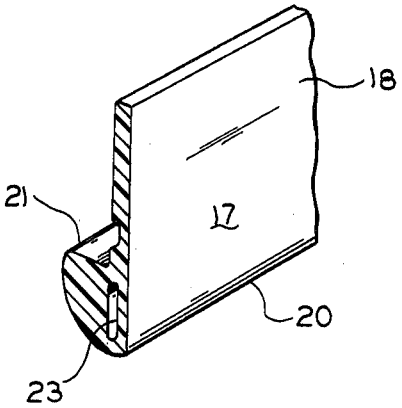
FIG. 3 is a detailed isometric view of part of the closure structure.
Figure 2:
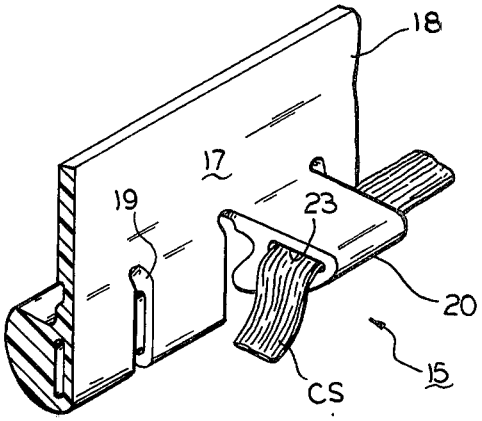
FIG. 2 is an enlarged isometric view showing a portion of the closure structure.
Figure 1:
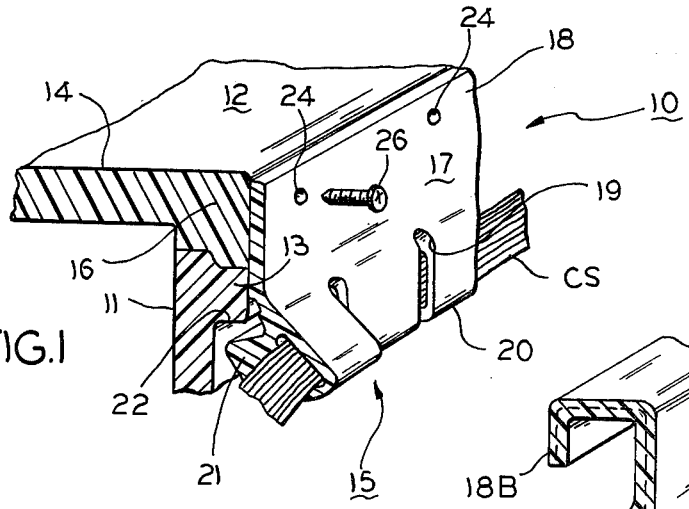
FIG. 1 is an isometric view of a portion of a container body and cover therefor, showing a portion of a closure arrangement positioned for sealing the cover and body together.

The closure arrangement according to one embodiment of the invention is denoted generally by the reference numeral 10 and is shown in the environment of a container body 11 having an open top and an annular stiffening rib 13. A cover 12 for the body 11 has a central portion 14 and a peripheral rim 16 arranged to lie upon the annular stiffening rib 13 in sealing engagement therewith.

A clamping structure for maintaining rib 13 and rim 16 in sealing engagement is denoted by reference numeral 15 and is formed of a band 17 having an upper extremity 18 in contact with the rim 16 and a lower extremity 20 in contact with the stiffening rib 13. The lower extremity 20 is discontinuous by reason of slots 19 and is provided with inward extending protuberances 21 which move into engagement with a lower shoulder 22 on the rib 13.

The upper extremities 18 of the clamping band 17 are held in a position against the rim 16 by self-tapping screws 26 threaded into bores 24 in the extremities 18 extending also into the rim 16.

The lower extremity 20 is provided with guideways 23 for a clamping strand CS which is tensioned in a well known manner to cause the band 17 to engage the rib 13 tightly at the shoulder 22 and thereby provide a tight seal between the rim 16 and the rib 13.

Figure 6:
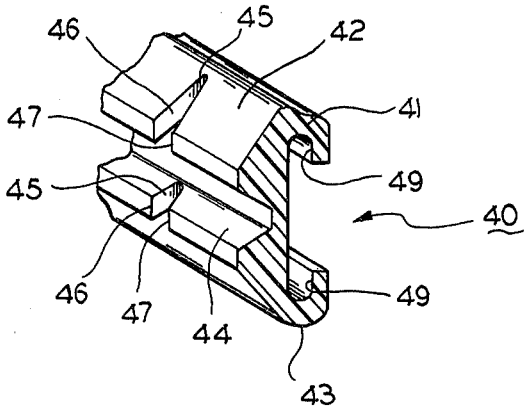
FIG. 6 is an isometric view showing further details of the closure structure of the second embodiment.
Figure 5:
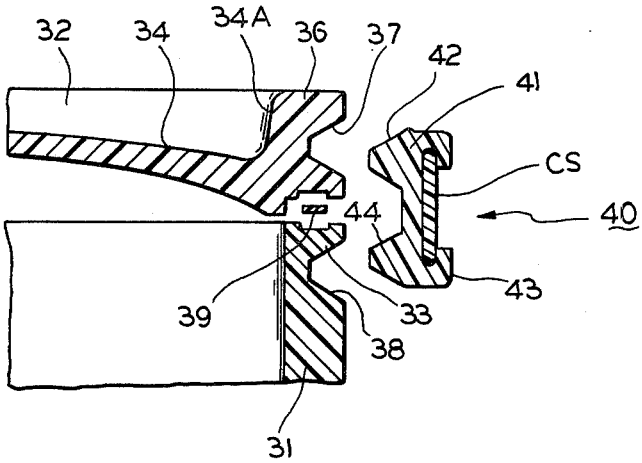
FIG. 5 is an exploded view of FIG. 4.
Figure 4:
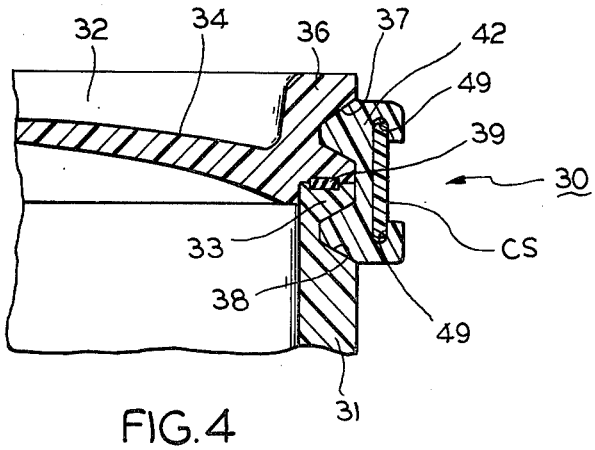
FIG. 4 is a cross-sectional view showing a second embodiment for sealing the cover to the container body.

Referring now to FIGS. 4 to 6 inclusive, there is shown another embodiment of the invention referred to generally by reference numeral 30. It is shown in the environment of a container body 31 having an upper annular stiffening rib 33 with a cover 32 having a center portion 34 and a peripheral rim 36, the surface of the center portion 34 lying below the upper surface of the rim 36.

The rim 36 has an outward facing annular groove 37 of essentially triangular cross section, while the stiffening rib 33 has a similar outward facing groove 38 also of triangular cross section.

The rim 36 and the rib 33 have a gasket 39 interposed therebetween.

A clamping band generally indicated by reference numeral 40 consists of upper and lower extremities 41 and 43 with an upper land 42 extending into the groove 37 and a lower land 44 extending into the groove 38.

The lands 42 and 44 are interrupted by cuts 46 and 47 defining V-shaped slots 45.

The clamping band 40, best seen in FIG. 6, is provided with upper and lower grooves 49 which guide the clamping strand CS, tensioned in a well known manner, causing the band 40 and the lands 42 and 44 thereto to tightly engage the respective grooves 37 and 38.

The application of tension causes the slots 45 to close and maintain a very tight seal between the cover 32 and a container body 31.

Figure 7:
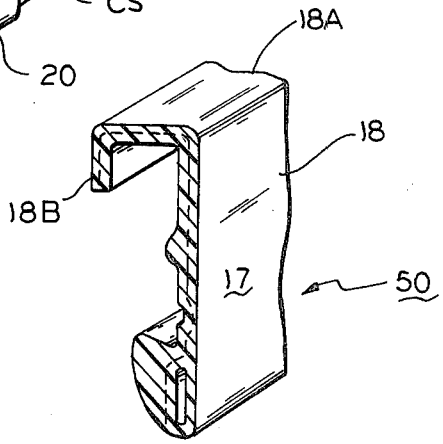
FIG. 7 is an isometric view showing details of a portion of another form of closure structure.

Referring now to FIG. 7, there is shown a clamping structure 50 especially adapted for use with a recessed cover, as seen in FIGS. 4 and 5, but formed without the groove, such as the groove 37 seen in FIG. 5. The clamping band 17 of FIG. 7 has its upper extremity 18 configured as at 18A to overlie the rim 36 with a dependent limb 18B thereof bearing against a flange face 34A (as shown in FIG. 5) of the rim 36.

I claim:

1. In a sealable closure arrangement for a plastic container body and a fully removable cover of like material therefor:

(a) a unitary, tubular body having an open upper end terminating in an annular stiffening rib;

(b) said rib having a shoulder extending radially from said body;

(c) a cover having a central portion and a peripheral rim arranged to lie upon said annular stiffening rib in sealing engagement therewith;

(d) clamping structure for maintaining said rib and said peripheral rim in sealing engagement comprising a clamping band engageable with said stiffening rib and said peripheral rim, the upper extremities of said clamping band being in engagement with said peripheral rim and the lower extremities of said clamping band being in engagement with said annular stiffening rib;

(e) the lower extremities of said clamping structures being in the form of a skirt discontinuous at intervals throughout the length thereof to provide for constriction thereof about said container body at said stiffening rib;

(f) said skirt having a guideway therein for a strand positioned therein and adapted to be tensioned so as to force said skirt against said shoulder and said container body.

2. A sealable closure arrangement according to claim 1, wherein both the upper and lower extremities of said clamping structure are in the form of a skirt with discontinuous portions arranged to close upon each other upon tensioning of said strand.

3. A sealable closure arrangement according to claim 2, wherein said stiffening rib and said peripheral rim are each provided with an outfacing annular groove to receive the upper and lower extremities of said clamping structure.

4. A sealable closure arrangement according to claim 1, wherein the upper extremities of said clamping structure extend over and around said peripheral rim.

5. A sealable closure according to claim 1, wherein the upper extremities of said clamping structure are secured to said peripheral rim by separate securing means.

* * * * *